US010647397B2

(12) United States Patent
Garthwaite

(10) Patent No.: US 10,647,397 B2
(45) Date of Patent: May 12, 2020

(54) ROBOTIC JELLYFISH

(71) Applicant: Martin Spencer Garthwaite, Bainbridge Island, WA (US)

(72) Inventor: Martin Spencer Garthwaite, Bainbridge Island, WA (US)

(73) Assignee: Fishboat Incorporated, Baibridge Island, WA (US)

( * ) Notice: Subject to any disclaimer, the term of this patent is extended or adjusted under 35 U.S.C. 154(b) by 14 days.

(21) Appl. No.: 16/015,352

(22) Filed: Jun. 22, 2018

(65) Prior Publication Data

US 2018/0370609 A1 Dec. 27, 2018

Related U.S. Application Data

(60) Provisional application No. 62/524,466, filed on Jun. 24, 2017.

(51) Int. Cl.

| | |
|---|---|
| ***B63H 19/00*** | (2006.01) |
| ***B63G 8/00*** | (2006.01) |
| ***B63B 35/00*** | (2020.01) |

(52) U.S. Cl.

CPC ..... *B63H 19/00* (2013.01); *B63B 35/00* (2013.01); *B63G 2008/002* (2013.01)

(58) Field of Classification Search

CPC .... B63H 19/00; B63B 35/00; B63G 2008/002

USPC ..... 440/13, 14, 15

See application file for complete search history.

(56) References Cited

U.S. PATENT DOCUMENTS

| | | | | |
|---|---|---|---|---|
| 2,936,729 | A * | 5/1960 | Kuttner | A63H 23/02 440/6 |
| 6,138,604 | A * | 10/2000 | Anderson | B63G 8/08 114/332 |
| 2013/0222115 | A1* | 8/2013 | Davoodi | H04Q 9/00 340/10.1 |
| 2015/0346726 | A1* | 12/2015 | Davoodi | B63B 22/24 701/21 |
| 2016/0304179 | A1* | 10/2016 | Garthwaite | B63B 21/66 |

FOREIGN PATENT DOCUMENTS

CN 103342163 B * 4/2016

OTHER PUBLICATIONS

"Towards a Miniature Self-propelled Jellyfish-like Swimming Robot", International Journal of Advanced Robotic Systems, Sep.-Oct. 2016, Authors—Yu, Xiao, Li, and Wang (Year: 2016).*

* cited by examiner

*Primary Examiner* — Anthony D Wiest

(57) ABSTRACT

A robotic jellyfish comprises a torque reaction engine and a jellyfish body, wherein the torque reaction engine cyclically oscillates and causes a wave to propagate across the jellyfish body, accelerating thrust fluid and propelling the robotic jellyfish.

18 Claims, 11 Drawing Sheets

ROBOTIC JELLYFISH

CROSS-REFERENCE TO RELATED APPLICATIONS

For all purposes, this application claims the filing date benefit of and incorporates the subject matter of U.S. provisional patent application Ser. No. 62/524,466, filed Jun. 24, 2017.

BACKGROUND

U.S. patent application Ser. No. 15/101,901 discloses a torque reaction engine (TRE), which may be used in a watercraft to achieve a fish-like motion. The resulting craft swims like a fish or marine mammal, without the myriad parts that plague other mechanical craft that attempt to swim like a fish or marine mammal.

At times it may be desirable to swim in other modes, such as like a jellyfish.

SUMMARY

Figure 1A:
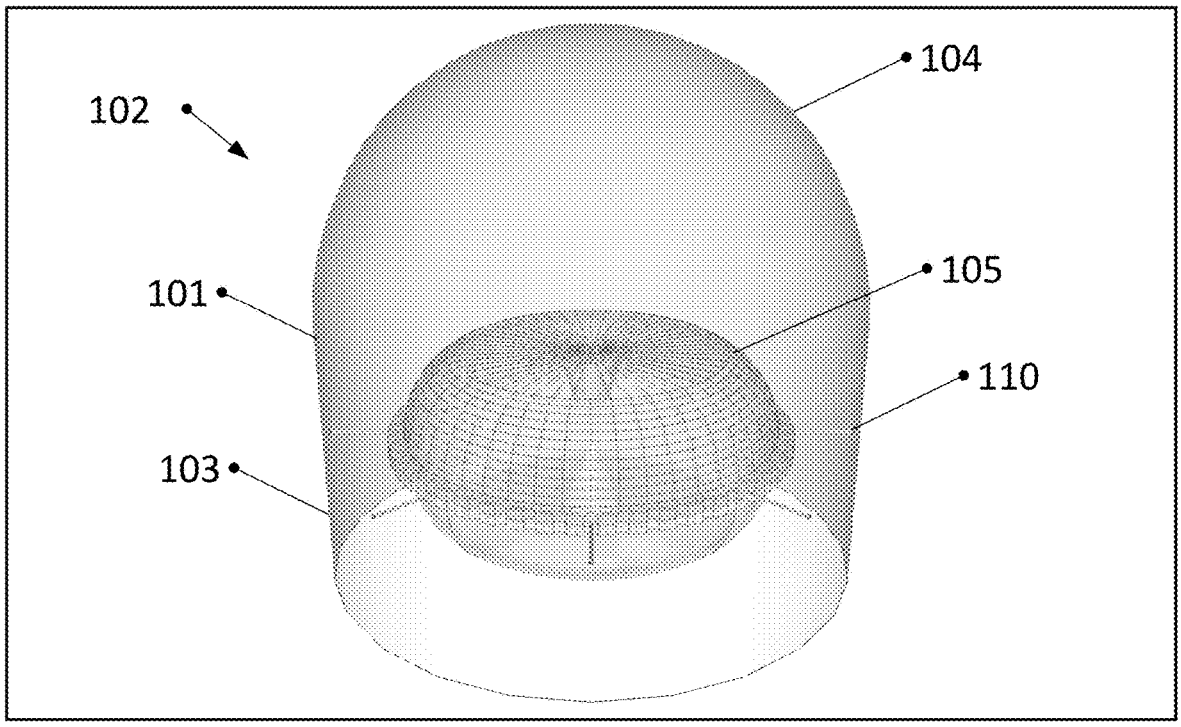
FIG. 1A illustrates an example of a robotic jellyfish including a torque reaction engine.

Certain of the inventions disclosed herein comprise systems and apparatus to accelerate thrust fluid and to produce thrust like a jellyfish, through use of one or more torque reaction engine (TRE).

DETAILED DESCRIPTION

It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

The figures and text therein illustrate and discuss examples of a craft that accelerates thrust fluid and achieves thrust like a jellyfish, through use of more than one torque reaction engine (TRE).

As discussed herein, "thrust fluid" may include a gas, a liquid, a plasma or other media comprising mass, wherein the media may be accelerated by a moving fin, propeller, tubular curtain, or the like ("fin"), and wherein the fin may be moved by a motor or wherein the thrust fluid is of a stream of thrust fluid and the stream of thrust fluid moves the fin.

As used herein, "releasable," "connect," "connected," "connectable," "disconnect," "disconnected," and "disconnectable" refers to two or more structures which may be connected or disconnected, generally without the use of tools or chemical or physical bonding (examples of tools including screwdrivers, pliers, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached.

As used herein, the central shaft may also be or be referred to as a "stator" or a "drive shaft" and the inertial mass may be or may be referred to as a "rotor". These identifiers are somewhat arbitrary, except inasmuch as they distinguish a first component and a second component, wherein one of the two components carries an inertial mass, and wherein the first and second components may rotate relative to one another around a common axis.

As discussed herein, each TRE comprises a central shaft (or "driveshaft") secured to a portion of a hull, beam, and/or fin of a craft (collectively referred to as "hull" or "tubular curtain"), an inertial mass located around (as in the case of TRE 105 and 136) or within the central shaft (as in the case of TRE 201), wherein an engine may be located between and/or may comprise the inertial mass and the central shaft. The engine causes the inertial mass to change its acceleration around, within, or relative to the central shaft, such as by slowing down, speeding up, or reversing rotation of the inertial mass. A bearing or set of bearings may be located between the inertial mass and the driveshaft. The bearing or set of bearings may allow the inertial mass and driveshaft to rotate relative to one another; rotation of these components relative to one another may include rotation about a common central axis of rotation. The inertial mass may comprise, for example, lead, iron, steel, a pack of batteries, a lead-acid paste battery, a lead-acid paste battery in a toroidal shape, an electromagnet, a heavy or dense object, and the like. Torque reaction produced on the central shaft by change in acceleration of the inertial mass by the engine causes the central shaft and the hull (or portion of hull) secured to such central shaft to rotate, opposite the change in acceleration of the inertial mass.

The central shaft may be secured to the interior of a pressure vessel. The pressure vessel may contain the TRE and form its exterior surface that is secured to the remainder of the hull. The pressure vessel is also referred to herein as "portion of a hull". The pressure vessel may seal the electronic components away from the surrounding thrust fluid, such as surrounding water.

Unlike conventional craft that accelerate thrust fluid through use of a propeller connected to a motor via a driveshaft, there may be no penetration in the pressure vessel of a TRE for a moving component, such as a driveshaft. In conventional inboard watercraft, the driveshaft typically penetrates the hull, requiring a seal around the spinning driveshaft. The driveshaft seal presents a problem for conventional craft. It can leak and degrade. It is a source of friction. It costs money to fabricate and maintain. In craft that go deep in water (e.g., more than several hundred feet), to prevent high pressure water from leaking through the driveshaft seal, a complex labyrinth seal may be used or an electric motor connected to the propeller may be flooded with oil. The labyrinth seal or oil may prevent water from contaminating the motor; however, labyrinth seals still have depth limitations and are a source of drive train friction and flooding a motor with oil significantly decreases its operating efficiency. Penetrations in the hull to accommodate a moving component such as a driveshaft are a real and severe problem that limits depth and operating range.

In contrast in a TRE, there does not have to be a penetration in the pressure vessel or hull for a moving component, because the central shaft (or driveshaft) is secured to the interior of the pressure vessel.

The pressure vessel may be toroidal in shape, such that a passage passes through a center of the central shaft. However, the passage through the center of the central shaft in a toroidal pressure vessel does not penetrate the toroidal pressure vessel. Such a passage may be used to secure a harness to the craft, to exhaust heat from the TRE, as a location for environmental sensors, or as a conduit for transmitting data, signals, or power into an interior of the TRE.

The engine may be located between and/or may comprise one or more of the inertial mass and the driveshaft. The engine causes the inertial mass to change its acceleration vector relative to the driveshaft, such as by slowing down, speeding up, or reversing rotation of the inertial mass relative to the driveshaft. Torque reaction produced on the driveshaft by change in acceleration vector of the inertial mass by the engine causes the driveshaft and portion of the hull secured to such driveshaft to experience a torque reaction. If the portion of the hull is not held in place by an external object, the torque reaction on the driveshaft will cause the portion of the hull to rotate, opposite a change in acceleration vector of the inertial mass.

The TRE may be controlled by a controller to cyclically reverse an acceleration vector of the inertial mass. Torque reaction on the driveshaft by cyclic reversal of the acceleration vector of the inertial mass causes the driveshaft to cyclically rotate in a first direction (such as clockwise), then in a second direction (such as counterclockwise), then in the first direction, etc., opposite the acceleration vector of the inertial mass, so long as power is available and the controller comprises suitable instructions. Cyclic rotation of the driveshaft in the first and second directions may be referred to herein as, "cyclic oscillation".

During a first phase of operation of a TRE, the motor may apply power to accelerate the inertial mass. During a second phase of operation of the TRE, the motor may apply a brake to decelerate the inertial mass. The motor may be an electric motor or an internal combustion motor. The brake may generate power, such as when the motor is an electric motor and the brake is an electronic or magnetic brake or such as when the motor is an internal combustion engine and the brake compresses a system to compress gas or accelerate a fly wheel.

In an example discussed herein, the driveshaft of a TRE is secured to a craft. The driveshaft may be secured to a hull of the craft, a pressure vessel and/or isolation capsule surrounding the TRE, a beam, or the like ("beam" or "pressure vessel"). At least a fin or circular curtain is secured to the pressure vessel. Cyclic oscillation of the driveshaft is communicated to the fin or circular curtain by the pressure vessel, resulting in translation of the fin, back and forth, through a surrounding thrust fluid, resulting in acceleration of the thrust fluid, or, when the fin is a tubular curtain, resulting in contraction and expansion of the tubular curtain, resulting in acceleration of thrust fluid surrounding the tubular curtain. Acceleration of thrust fluid results in thrust and/or lift on the fin or by the tubular curtain, which may propel the craft.

A flexible material of or secured to the tubular curtain secured to the driveshaft may flex in response to movement of the driveshaft. Such flex may compress and/or expand the flexible material, such as between at least first and second shapes. The flexible material may store energy as it compresses or expands. The flexible material may release stored energy and return to an original or resting shape, as may occur when the central shaft stops moving; alternatively, the flexible material may be pliable and/or may not store appreciable energy. The flexible material may transition between at least first and second shapes in response to or as allowed by movement of at least a first and a second TRE and/or in response to or as allowed by release or storage of energy in the flexible material.

The flexible material may comprise rubber, polyurethane, carbon fiber, carbon fiber embedded in resin, gelatin, gelatin produced by a living organism, fiberglass, aramid, or the like.

The flexible material may have a first shape, wherein the first shape may be the shape of a curtain, a tubular curtain, a beam, or the like, wherein the first shape may be a resting shape, and/or wherein the first shape may store or comprise a different amount of energy relative to a second shape, wherein the energy may be potential energy.

The flexible material may have at least a second shape. The second shape may be a compressed, stretched, expanded, or bent version of the first shape.

Transition between the first and second shapes may be caused by and/or may produce a wave. The wave may traverse the flexible material or may be a standing wave in the flexible material. The wave may store or release energy in a local portion of the flexible material. The wave may be produced by a movement of at least one TRE. One TRE may move relative to at least a second TRE; movement of more than one TRE may be in phase or out of phase.

One or more tendons may span between the TRE and the flexible material. The tendons may hold the TRE within the craft. The tendons may comprise fibers, rods, or the like. Rods may comprise joints, such as at the ends of the rods, where the rods contact the TRE and the flexible material.

Flexure of the tubular curtain caused by a TRE may cause a wave to propagate along the tubular curtain; more than one TRE may move relative to one another to cause a propagating wave ("wave") or a standing wave to form in the tubular curtain between at least two of the TREs. Propagation of the wave along the tubular curtain may be performed to accelerate thrust fluid and produce thrust. Production of a standing wave may be performed to bend the tubular curtain. Bending the tubular curtain may be performed to steer the craft. Production of the propagating wave and production of the standing wave may be performed simultaneously.

FIG. 1A illustrates an example of a robotic or mechanical jellyfish ("robotic jellyfish 102"). Robotic jellyfish 102 may comprise TRE 105, tendon 110, and flexible material 101 in a first shape with a first energy level; this may be referred to herein as a first flexible material energy phase. In FIG. 1, the first shape is tubular curtain 103, which functions as a fin. Tubular curtain 103 may engage with a thrust fluid surrounding robotic jellyfish 102. The first flexible material energy phase may not store energy. The first flexible material energy phase may be a relaxed state.

Figure 1B:
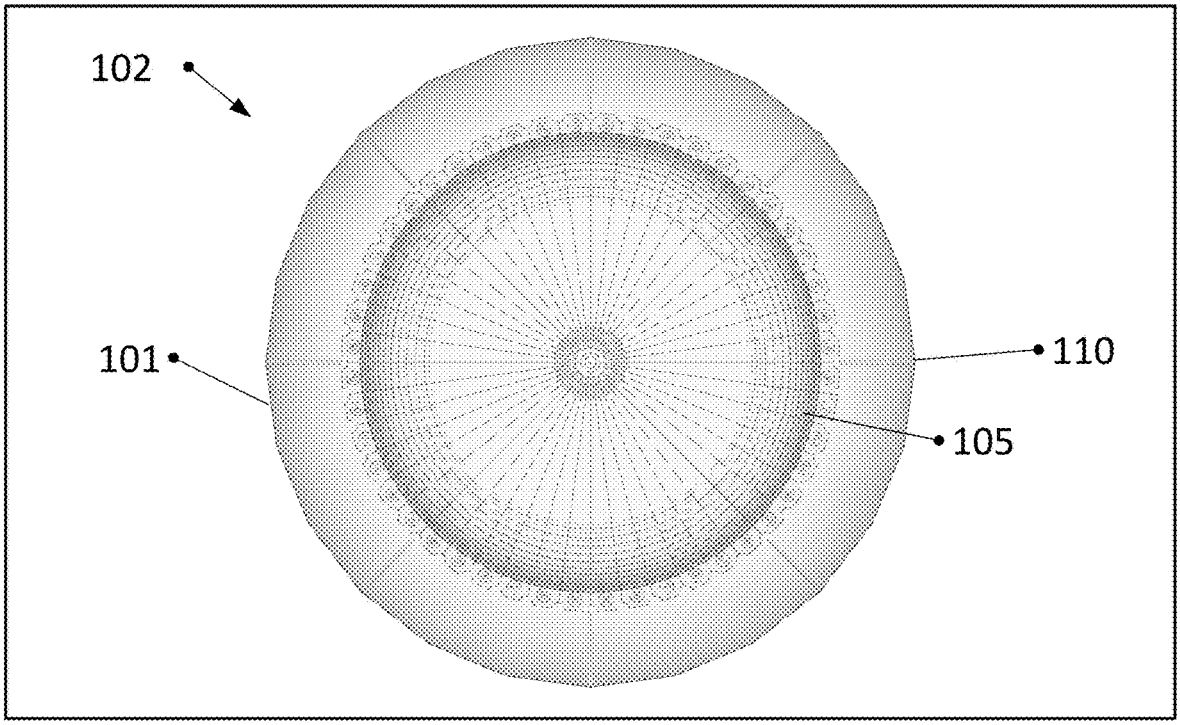
FIG. 1B illustrates the robotic jellyfish of FIG. 1A, in a top plan view.

FIG. 1B illustrates the robotic jellyfish of FIG. 1A, in a top plan view. Flexible material 101 of robotic jellyfish 102 is in first flexible material energy phase. Tendons 110 may suspend TRE 105 within robotic jellyfish 102. TRE 105 may not be undergoing cyclic oscillation.

Robotic jellyfish 102 may comprise displacement. Displacement may be variable. Displacement may be provided by a bladder, such as a bladder within or attached to TRE 105, within a top of jellyfish 102, by microbeads within flexible material 101, including microbeads filled with a gas or low-density material. The displacement may maintain positive, negative, or neutral buoyancy for robotic jellyfish 102.

Robotic jellyfish 102 in FIGS. 1A and 1B may further comprise dome 104; dome may also be referred to herein as a "top cap". Dome 104 may be made, for example, of a flexible material, such as flexible material 101. Dome 104 may comprise a transition to tubular curtain 103.

Figure 2A:
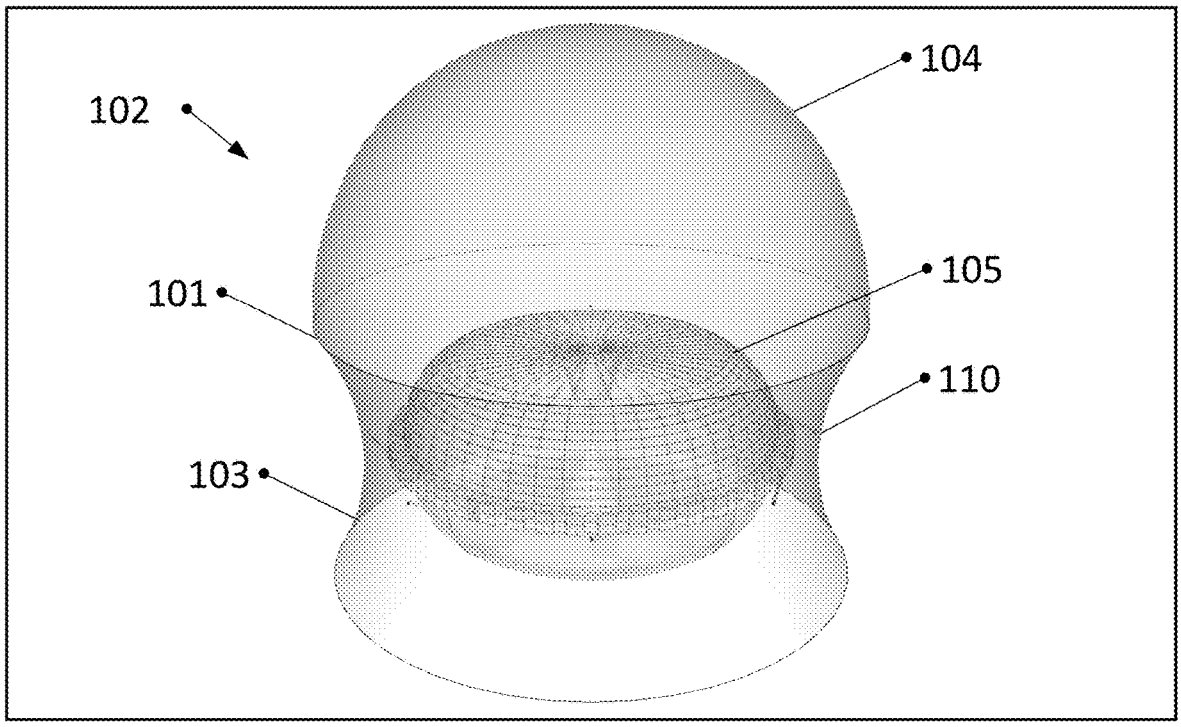
FIG. 2A illustrates the robotic jellyfish of FIG. 1A, during a first phase of motion of the torque reaction engine.
Figure 2B:
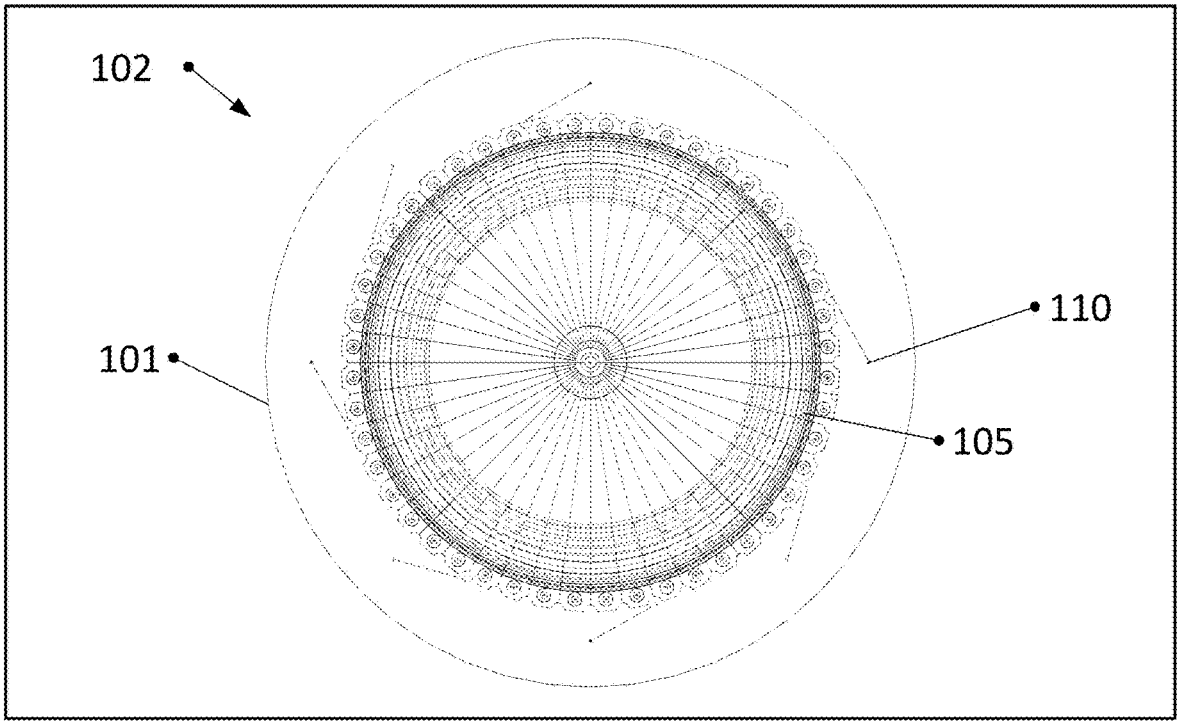
FIG. 2B illustrates the robotic jellyfish of FIG. 2A, in a top plan wireframe view.

FIG. 2A illustrates the robotic jellyfish of FIG. 1A, wherein TRE 105 may be in a second TRE phase and flexible material 101 may be in a second flexible material energy phase. The second TRE phase may, for example, comprise rotation of TRE 105. FIG. 2B illustrates the robotic jellyfish of FIG. 2A, in a top plan wireframe view. FIG. 2B illustrates that rotation of TRE 105 in the second TRE phase may be counter-clockwise (when viewed from above) relative to the first TRE phase.

When pulled by TRE 105, tendons 110 may pull flexible material 101 into, for example, the second flexible material phase. The second flexible material phase may, for example, store energy in flexible material 101, such as by bending or compressing flexible material 101 inward toward TRE 105 and/or by rotating a mass of flexible material 101, such as counter-clockwise. Rotation of the mass of flexible material 101 in the second flexible material phase may follow behind rotation of TRE 105 in the second TRE phase. Rotation of the mass of flexible material 101 in tubular curtain 103 in the second flexible material phase may follow behind rotation of TRE 105 in the second TRE phase and may precede a rotation of a mass of flexible material 101 in dome 104.

Transition between first and second flexible material energy phases may form a wave in flexible material 101, wherein the wave may propagate through flexible material 101 toward, for example, an open end of robotic jellyfish 102. Propagation of the wave may accelerate thrust fluid surrounding robotic jellyfish 102 and produce thrust.

Figure 3A:
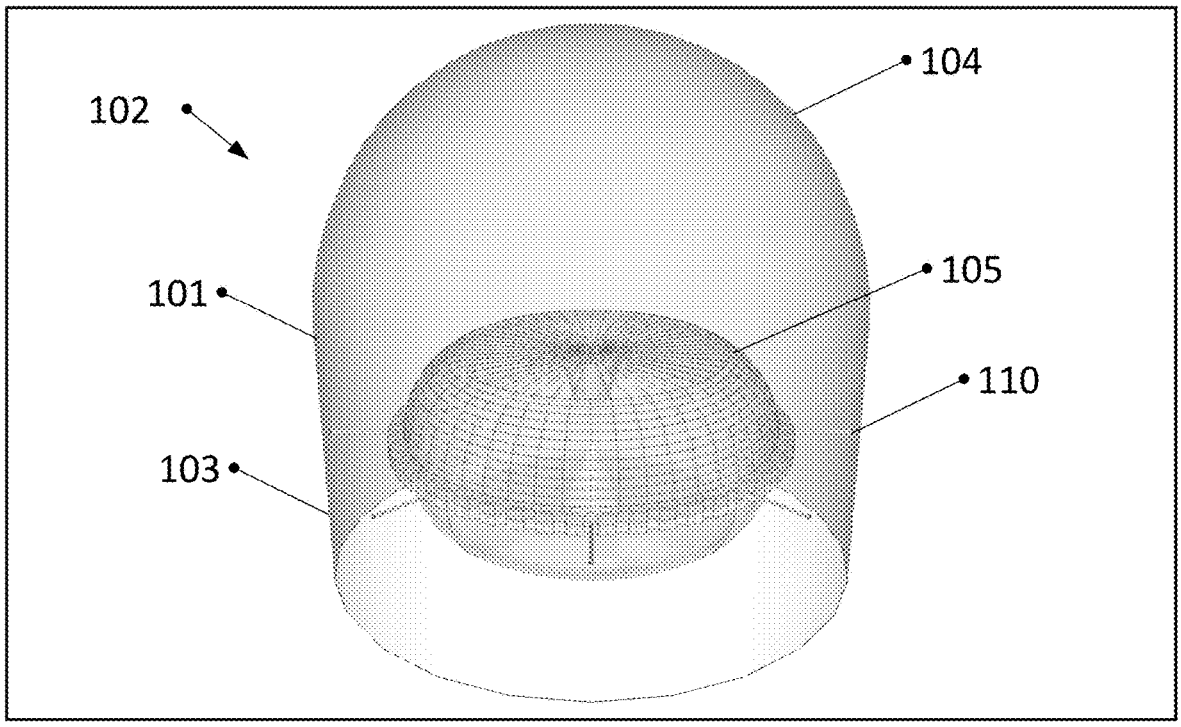
FIG. 3A illustrates the robotic jellyfish of FIG. 2A, during a second phase of motion of the torque reaction engine.
Figure 3B:
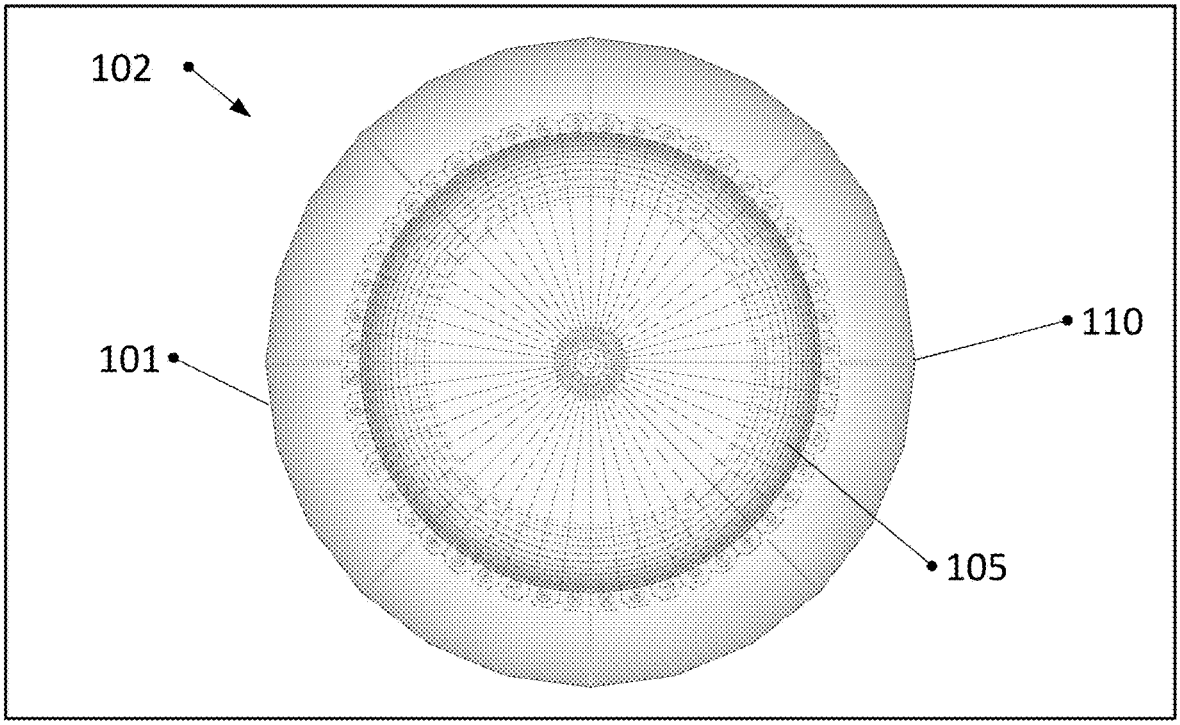
FIG. 3B illustrates the robotic jellyfish of FIG. 3A, in a top plan view.

FIG. 3A illustrates robotic jellyfish 102 of FIG. 2A, wherein TRE 105 may be in a third TRE phase and flexible material 101 may be in a third flexible material phase. The third TRE phase may, for example, comprise rotation of TRE 105. FIG. 3B illustrates robotic jellyfish 102 of FIG. 3A, in a top plan view. FIG. 3B illustrates that rotation of TRE 105 in the third TRE phase may be clockwise relative to the second TRE phase; the third TRE phase may return TRE 105 to a rotational position that is the same as or similar to the first TRE phase.

Through, for example, release of energy stored in flexible material 105 during the second flexible material phase, in third flexible material phase, flexible material 105 may expand outward and/or the mass of flexible material 105 in tubular curtain 103 may rotate clockwise relative to the second flexible material phase. Rotation of the mass of flexible material 101 in tubular curtain 103 in the third flexible material phase may follow behind rotation of TRE 105 in the third TRE phase and may precede a rotation of a mass of flexible material 101 in dome 104.

Transition between second and third flexible material energy phases may form a wave in flexible material 101, wherein the wave may propagate through flexible material 101 toward, for example, a closed end of robotic jellyfish 102. Propagation of the wave may accelerate thrust fluid surrounding robotic jellyfish 102 and may allow the interior of robotic jellyfish 102 to refill or recharge with thrust fluid.

Figure 4A:
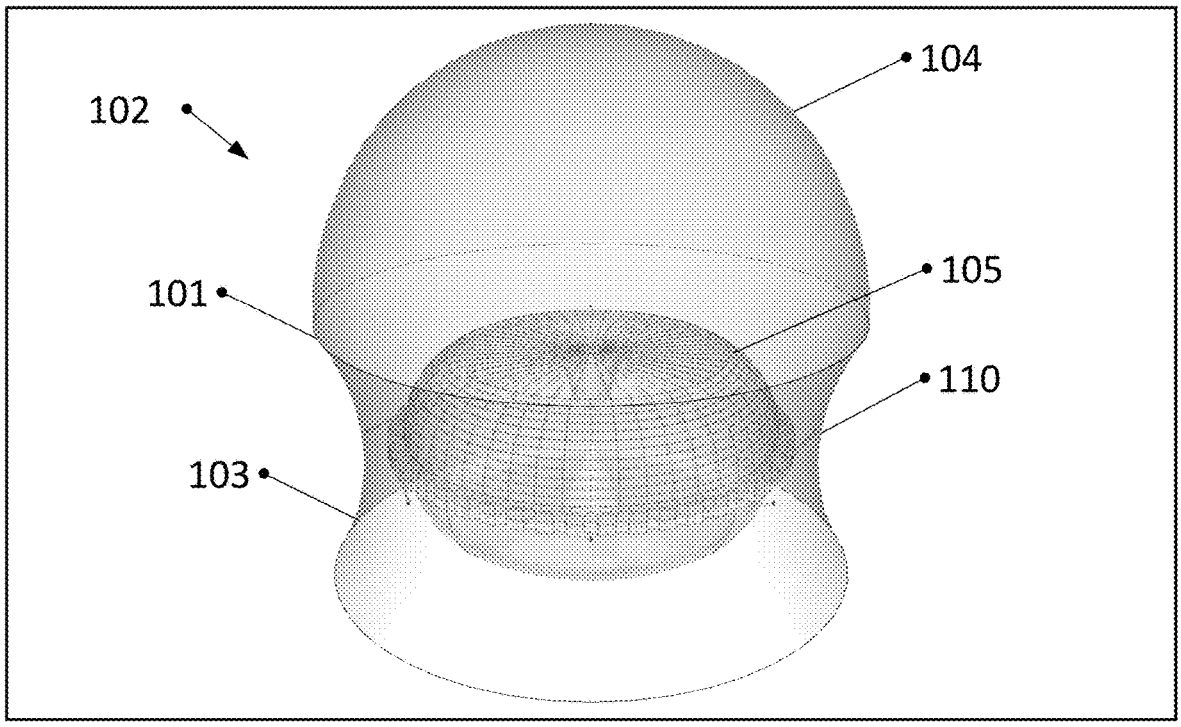
FIG. 4A illustrates the robotic jellyfish of FIG. 3A, during a third phase of motion of the torque reaction engine.
Figure 4B:
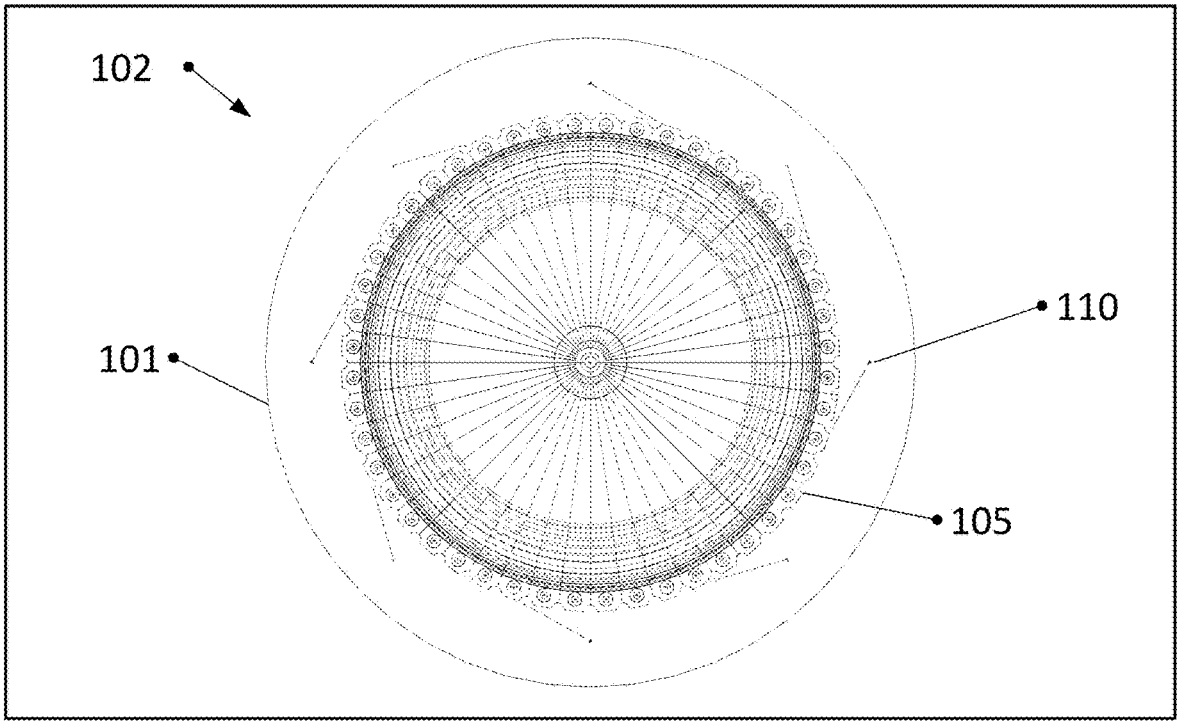
FIG. 4B illustrates the robotic jellyfish of FIG. 4A, in a top plan view.

FIG. 4A illustrates robotic jellyfish 102 of FIG. 3A, wherein TRE 105 may be in a fourth TRE phase and flexible material 101 may be in a fourth flexible material energy phase. The fourth TRE phase may, for example, comprise rotation of TRE 105. FIG. 4B illustrates robotic jellyfish 102 of FIG. 4A, in a top plan view. FIG. 4B illustrates that rotation of TRE 105 in the fourth TRE phase may be clockwise relative to the third TRE phase.

When pulled by TRE 105, tendons 110 may pull flexible material 101 into, for example, the fourth flexible material energy phase. The fourth flexible material energy phase may, for example, store energy in flexible material 101, such as by bending flexible material 101 inward toward TRE 105 and/or by rotating a mass of flexible material 101 in tubular curtain 103, such as clockwise. Rotation of the mass of flexible material 101 in tubular curtain 103 in the fourth flexible material phase may follow behind rotation of TRE 105 in the fourth TRE phase and may precede a rotation of a mass of flexible material 101 in dome 104.

Transition between third and fourth flexible material phases may form a wave in flexible material 101, wherein the wave may propagate through flexible material 101 toward, for example, the open end of robotic jellyfish 102. Propagation of the wave may accelerate thrust fluid surrounding robotic jellyfish 102 and produce thrust.

Figure 5:
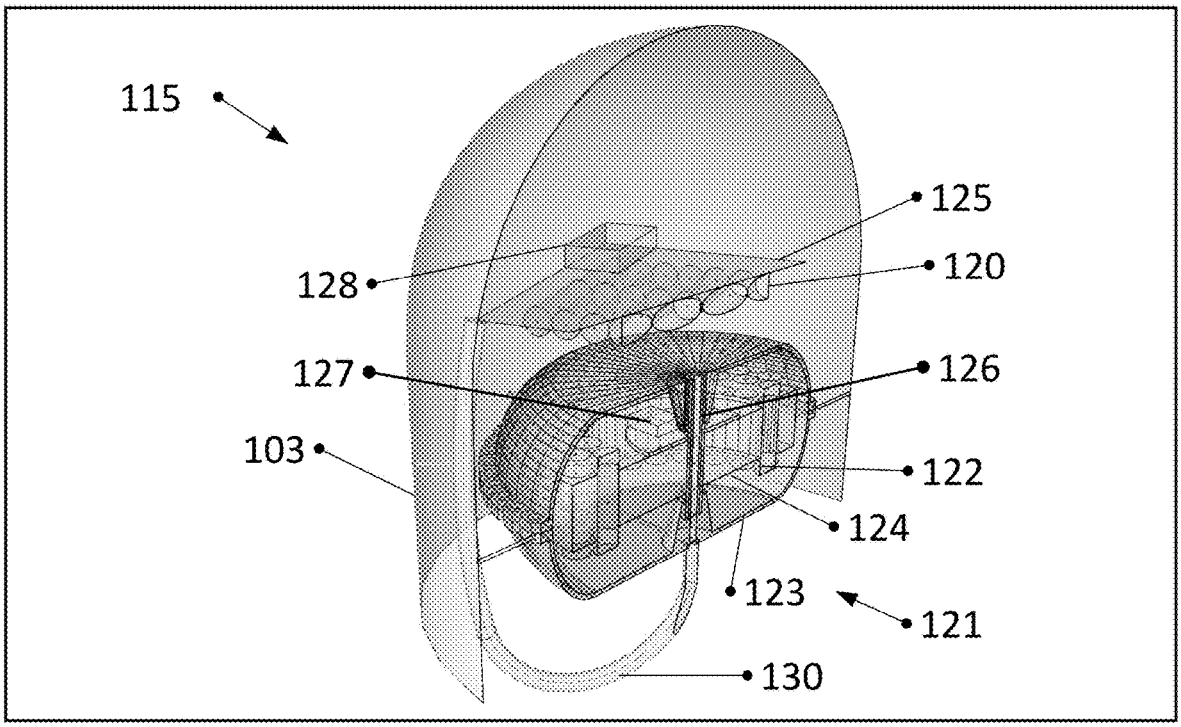
FIG. 5 illustrates a cross section of a robotic jellyfish including a torque reaction engine, a solar panel, a first battery pack coupled to the solar panel and a second battery pack internal to the torque reaction engine, wherein the second battery pack is used as an inertial mass by the torque reaction engine.

FIG. 5 illustrates a cross section of a robotic jellyfish 115 including TRE 121, solar panel 125, battery pack 120 coupled to solar panel 125, and pressure vessel 123. Pressure vessel 123 may be secured to driveshaft 126 of motor 124. Robotic jellyfish 115 may comprise a second battery pack 122 internal to TRE 121, wherein second battery pack 122 secured to motor 124 may be used as an inertial mass by TRE 121. Solar panel 125 may provide power to at least one of the battery pack(s) 120 and/or 122 of TRE 121, such as via cord 130 or a printed circuit board securing batteries 120 to solar panel 125. Cord 130 may carry power and/or data between solar panel 125 and/or battery pack 120 and/or 122 and/or computer and/or electronic equipment on solar panel 125 or in a dome of robotic jellyfish 115. Robotic jellyfish 115 may comprise motor controller 127, to control cyclic oscillation of TRE 121 and/or battery pack 122. Robotic jellyfish 115 may comprise power controller 128, to control battery pack 120 and supply of power to TRE 121.

A robotic jellyfish, such as, for example, robotic jellyfish 115, may be programmed to surface during the day to collect solar energy with solar panel 125 and to recharge batteries. Robotic jellyfish 115 may sink at dusk, such as through variable buoyancy or through change in attitude of robotic jellyfish 115 and application of power to TRE 121. At a programmed time and/or depth, robotic jellyfish 115 may reorient, if necessary, and/or apply power to TRE 121 to surface. When at a surface of water, robotic jellyfish 115 may transmit data to terrestrial, airborne, or satellite transceivers. Robotic jellyfish may comprise transceivers to communicate acoustically, optically, or using other structured energy transmission media.

A robotic jellyfish may be programmed to identify or receive information regarding currents at different depths in a surrounding thrust fluid and may use such currents to navigate.

A robotic jellyfish may comprise acoustic sensors and emitters, as well as radio frequency sensors and emitters. A robotic jellyfish may use flexible material as a component of such sensors and emitters.

Buoyancy for robotic jellyfish 115 may be provided at least in part by flexible material and/or by one or more displacement volume(s). Displacement volume(s) may comprise, for example, a vacuum, a gas or a liquid that is lighter or heavier than a surrounding thrust fluid. A volume of such vacuum, gas, or liquid may be increased or decreased within the displacement volume, such as by a pump, a piston, a valve or the like. The displacement volume may, for example, occupy one or more sectors of the flexible material. The vacuum, gas, or liquid may be pumped or allowed to pass between within the sectors to relocate the center of displacement of the robotic jellyfish.

The center of mass of the robotic jellyfish may be changed by changing the location of the TRE. The location of the TRE may be changed by, for example, changing the length of different of the tendons that secure the TRE to the flexible material.

A center of displacement of a robotic jellyfish and/or a center of mass of the robotic jellyfish may be changed to change an orientation of the robotic jellyfish relative to surrounding thrust fluid and/or a gravitational field. Change in orientation of the robotic jellyfish may be performed to steer the robotic jellyfish. Buoyancy may be adjustable, to increase or decrease buoyancy.

Figure 6:
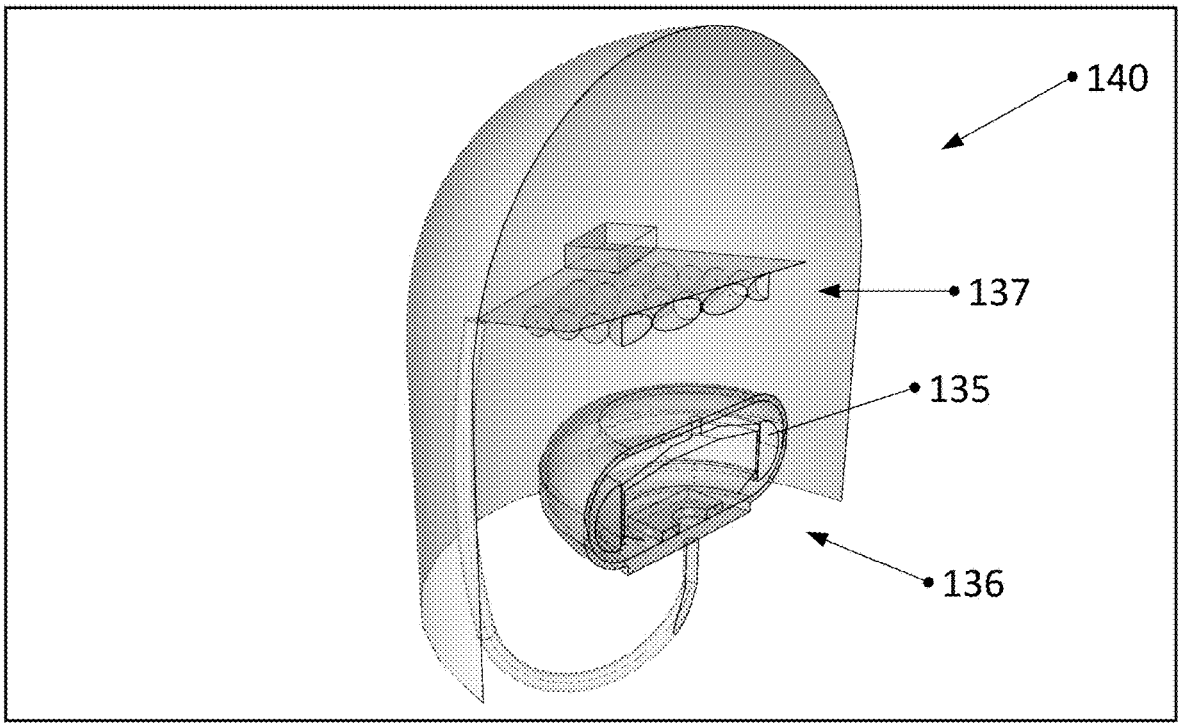
FIG. 6 illustrates a cross section of a robotic jellyfish including a torque reaction engine, wherein the torque reaction engine uses an inertial mass other than a battery pack.

FIG. 6 illustrates a cross section of a robotic jellyfish 140 including TRE 136, wherein TRE 136 uses an inertial mass 135 other than a battery pack internal to TRE 136. Tendons securing TRE 136 to flexible material of robotic jellyfish 140 are not illustrated in FIG. 6. In robotic jellyfish 140, power may be supplied external to TRE 136, such as from a solar panel and/or battery pack 137.

Figure 7:
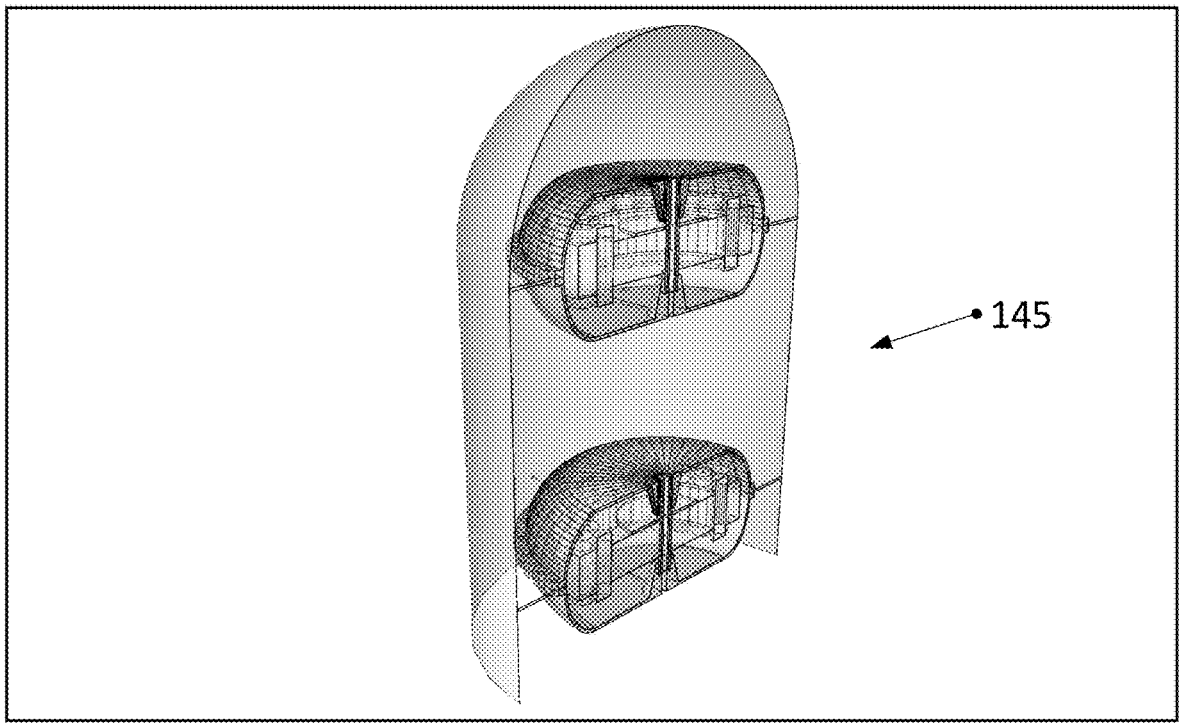
FIG. 7 illustrates a cross section of a robotic jellyfish including two torque reaction engines.

FIG. 7 illustrates a cross section of a robotic jellyfish 145 including two TREs. The two TREs may be power cycled in or out of phase with on another to produce at least one wave that traverses flexible material of robotic jellyfish 145. For example, when one TRE turns clockwise, the other may turn counter-clockwise. The location of the TREs in robotic jellyfish 145 may be other than as illustrated. For example, the lower TRE may be positioned higher up.

Figure 8A:
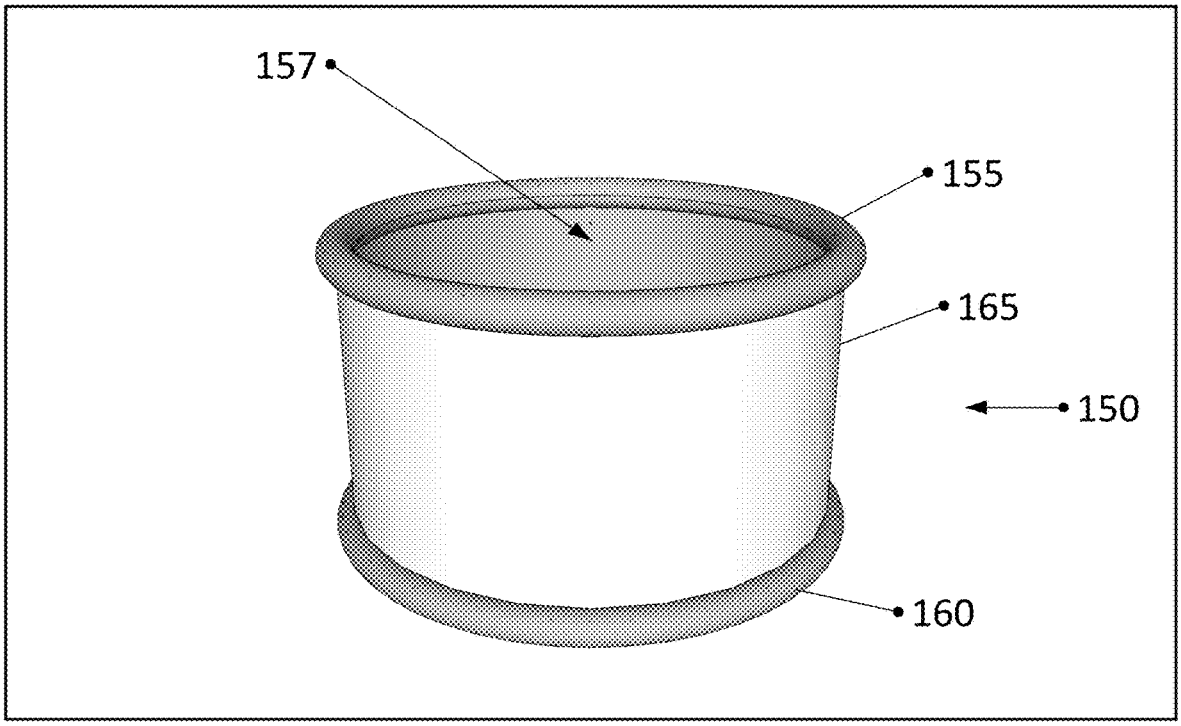
FIG. 8A illustrates a robotic jellyfish, lacking a top cap, including two TREs, and wherein the TREs have a large central opening.
Figure 8B:
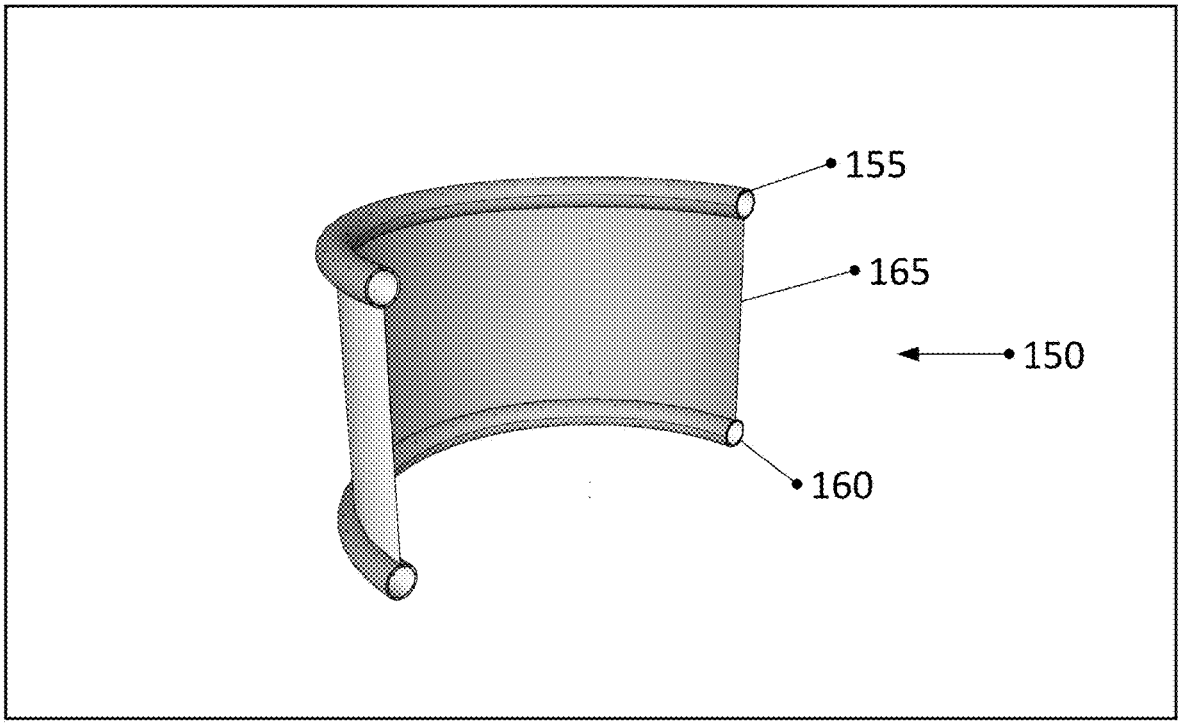
FIG. 8B illustrates the robotic jellyfish of FIG. 8A, with a vertical cross-section.

FIG. 8A illustrates robotic jellyfish 150 comprising flexible material 165, TRE 155 and TRE 160, and wherein the TREs comprise a large central opening 157. FIG. 8B illustrates a cross section of robotic jellyfish 150 of FIG. 8A. TRE 155 and TRE 160 may be power cycled by a controller in or out of phase. Flexible material 165 may comprise a curtain, a tubular curtain, or the like, also referred to herein as "tubular curtain". Robotic jellyfish 150 is illustrated with two TREs, TRE 155 and TRE 160; in an embodiment, one TRE may be used, including one TRE located centrally along flexible material 165. Flexible material 165 may extend below a bottom of robotic jellyfish 150.

Figure 9A:
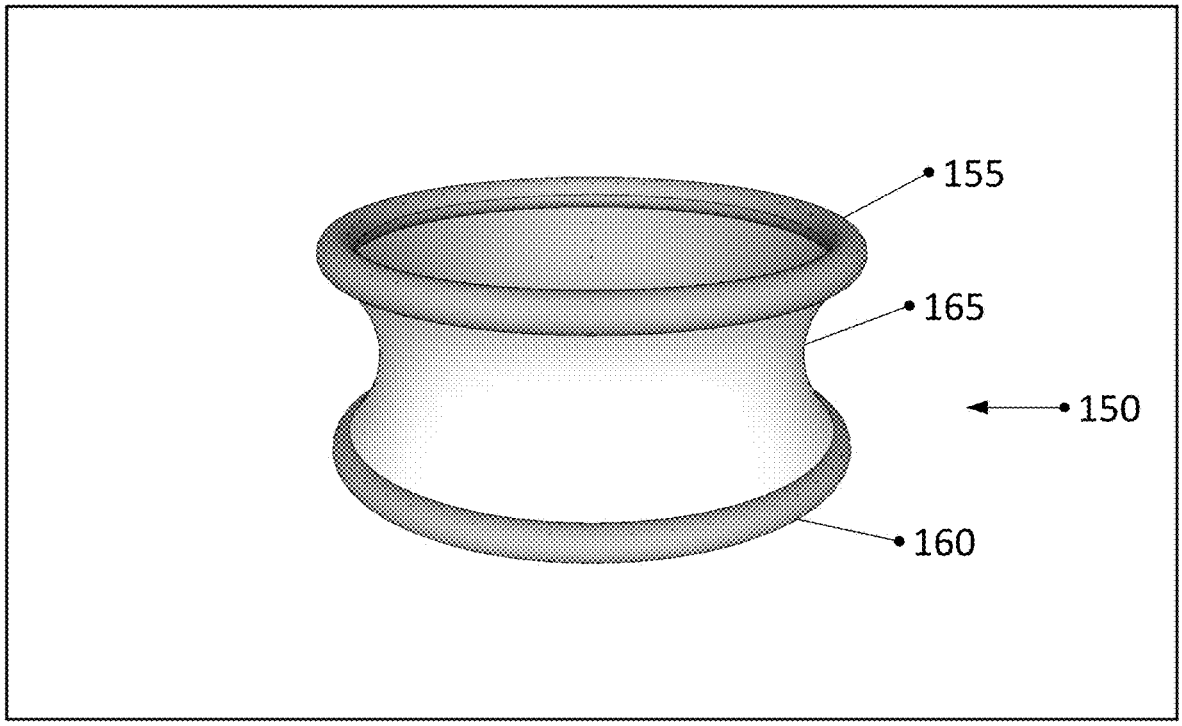
FIG. 9A illustrates the robotic jellyfish of FIG. 8A, wherein the at least one of the torque reaction engines is undergoing a portion of a power cycle.
Figure 9B:
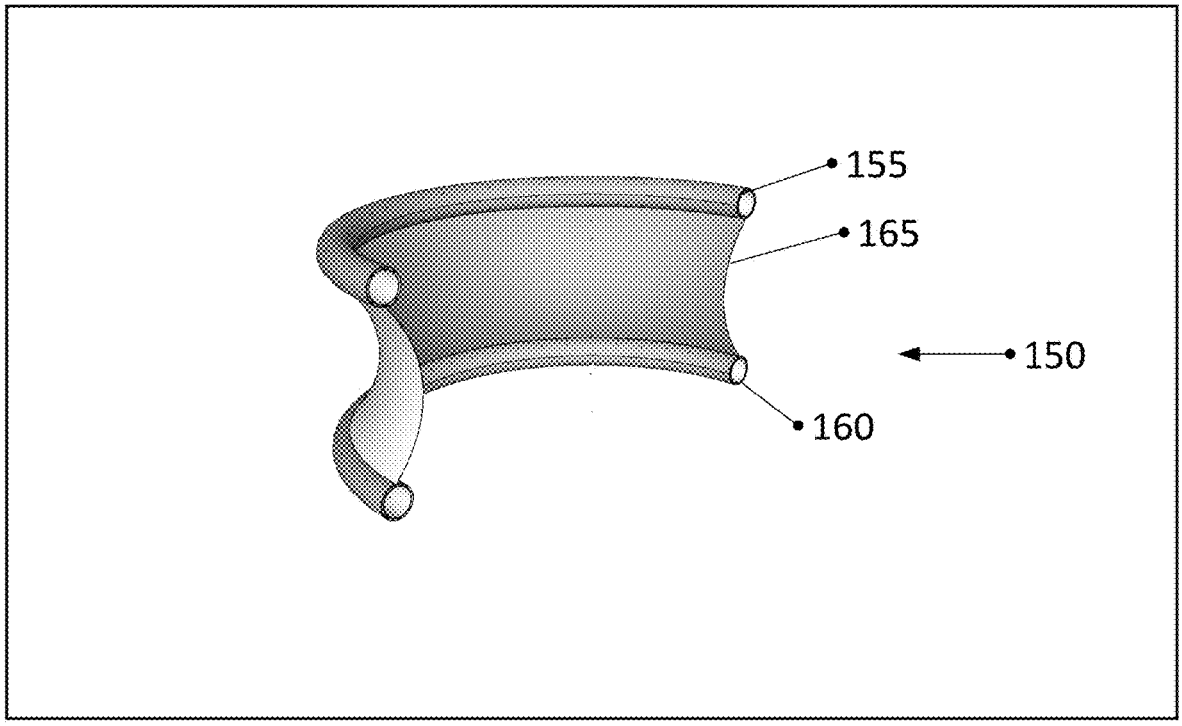
FIG. 9B illustrates the robotic jellyfish of FIG. 9A, with a vertical cross-section.

FIG. 9A illustrates robotic jellyfish 150 of FIG. 8A, wherein the at least one of TRE 155 and 160 undergo a portion of a power cycle. FIG. 9B illustrates robotic jellyfish 150 of FIG. 9A, with a vertical cross-section. During the portion of the power cycle, relative movement of TRE 155 and TRE 160 may cause compression of flexible material 165. Compression of flexible material 165 may be caused when, for example, TRE 155 rotates clockwise while TRE 160 rotates counter-clockwise.

As illustrated in FIG. 9B, flexible material 165 is a sheet that flexes inward. Flexible material 165 may comprise an outer face (not illustrated) that may flex outward. Flex of flexible material 165 may store energy. Differential rotation of the top and bottom of flexible material 165 produced by differential rotation of TRE 155 and TRE 160 may cause compression similar to how a thread shortens in length when one end of the thread is rotated. Compression of flexible material 165 may result in acceleration of thrust fluid surrounding robotic jellyfish 150.

In an alternative embodiment, combining robotic jellyfish 150 with robotic jellyfish 102, a robotic jellyfish may comprise one TRE with a large central opening, similar to TRE 155, located in a tubular curtain, for example at or approximate to a centerline of a tubular curtain, similar to TRE 105. Cyclic oscillation of such TRE may result in compression of the tubular curtain and propagation of a wave through the tubular curtain, resulting in thrust for the robotic jellyfish. Compression of the tubular curtain in response to rotation of the TRE may be transient, until rotation of the tubular curtain catches up to rotation of the TRE. When the TRE undergoes cyclic oscillation, such transient compression may occur during each half phase of a full power cycle, a full power cycle comprising a power cycle, during which an inertial mass is accelerated, and a braking cycle, during which the inertial mass is decelerated.

Figure 10A:
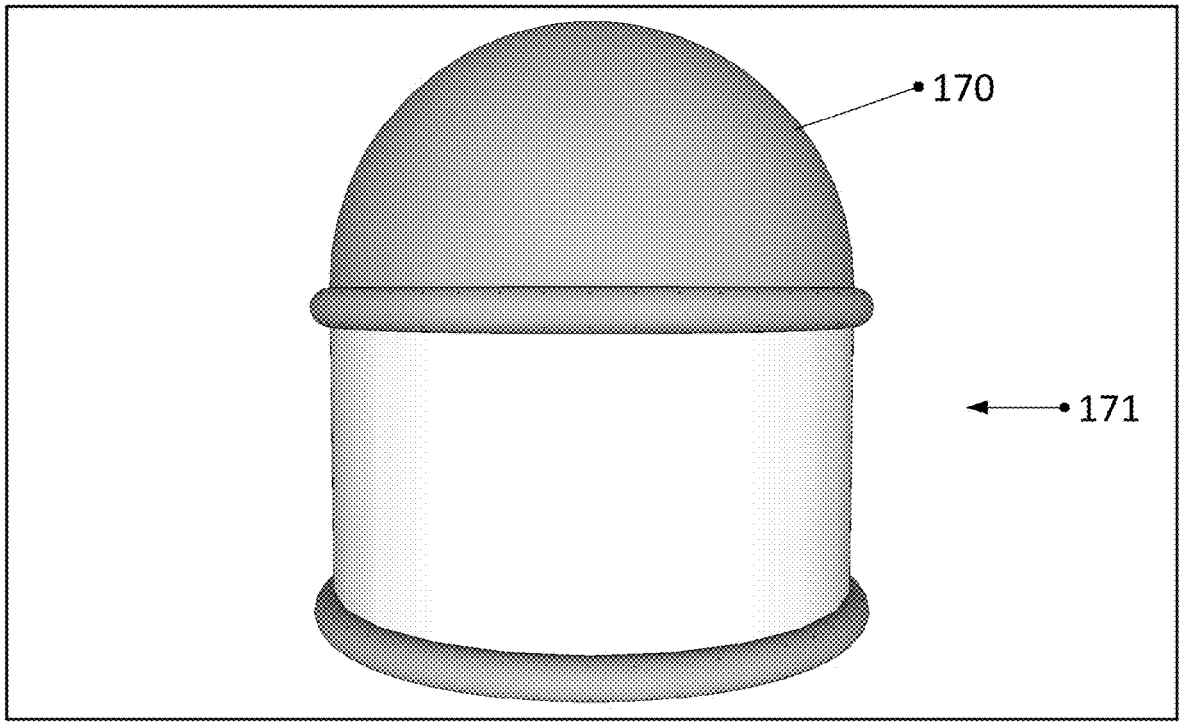
FIG. 10A illustrates a robotic jellyfish with a top cap, including two torque reaction engines, and wherein the torque reaction engines have a large central opening.

FIG. 10A illustrates a robotic jellyfish 171 with a top cap 170, including two TREs.

Figure 10B:
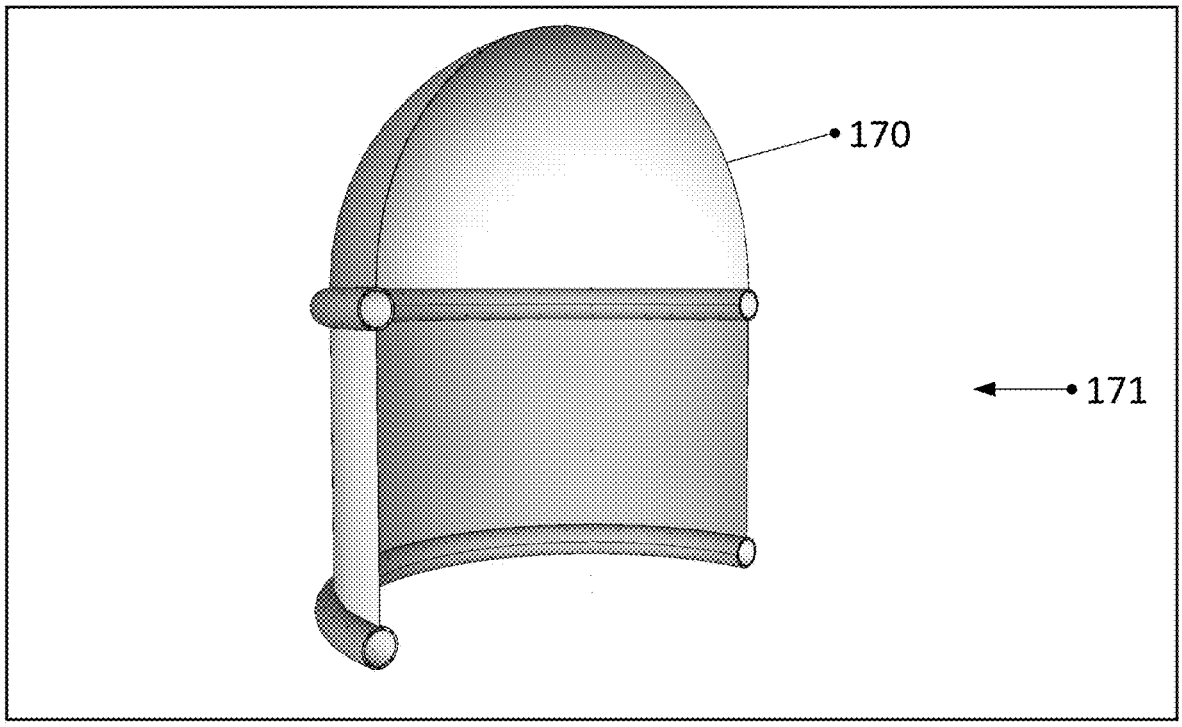
FIG. 10B illustrates the robotic jellyfish of FIG. 10A, with a vertical cross-section.

FIG. 10B illustrates the robotic jellyfish 171 and top cap 170 of FIG. 10A, with a vertical cross-section.

Figure 11:
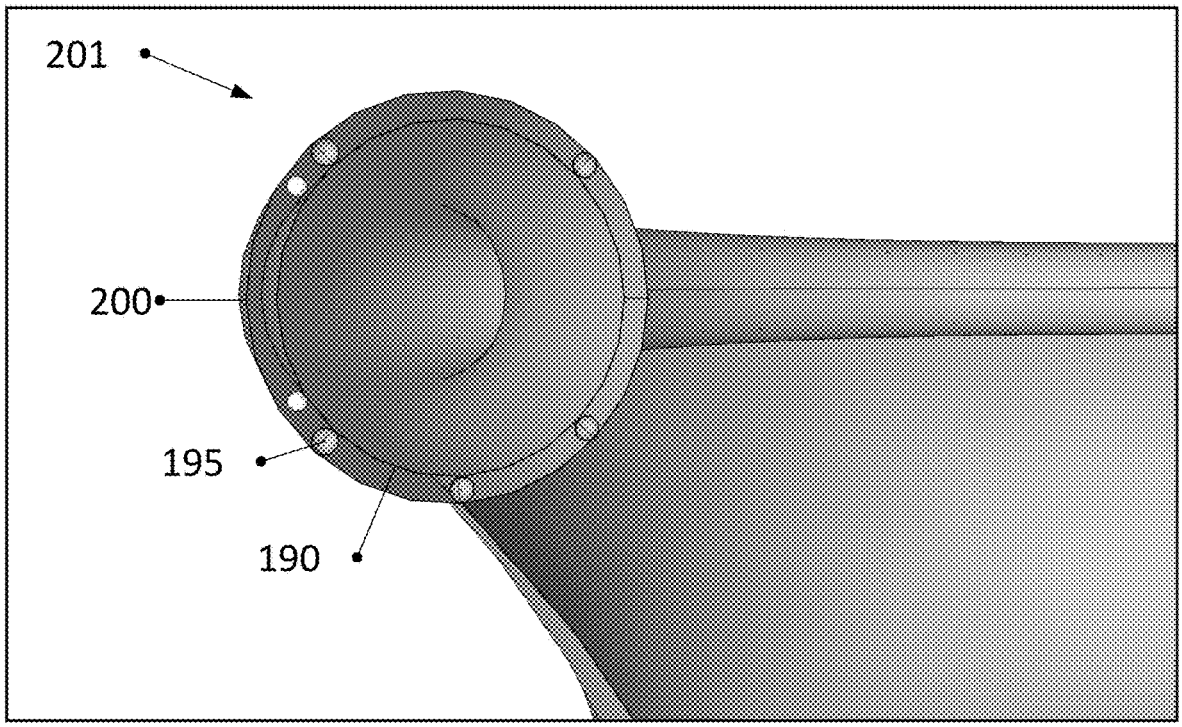
FIG. 11 illustrates a detail of a cross-section of a torque reaction engine.

FIG. 11 illustrates a detail of a cross-section of robotic jellyfish 201. This detail illustrates bearings 195, inertial mass 190, and outer shell 200. Inertial mass 190 may comprise within the space indicated by inertial mass 190, a battery pack, a radial battery, a radial battery pack, lead, iron, a permanent magnet, an electromagnet, or a similar dense material. Outer shell 200 may comprise permanent magnets, electromagnets, or the like. A motor may be formed from, between, or comprising outer shell 200 and inertial mass 190, wherein the motor changes a rate of acceleration of inertial mass 190 and subjects outer shell 200 to a torque reaction cause thereby. Power may be transferred to a battery pack or the like within inertial mass 190 through induction, through brushes (not illustrated) through a slip ring (not illustrated), or the like.

Example 1

A robotic jellyfish comprising a torque reaction engine within a jellyfish body.

Example 2

The robotic jellyfish according to Example 1 or some other Example herein, wherein the TRE relocates within the jellyfish body to produce a steering force.

Example 3

The robotic jellyfish according to one or more of Example 1 to Example 2 or some other Example herein, wherein the TRE is suspended from a dome of the jellyfish body.

Example 4

The robotic jellyfish according to one or more of Example 1 to Example 3 or some other Example herein, wherein the TRE is above or below a fin or curtain.

Example 5

The robotic jellyfish according to one or more of Example 1 to Example 4 or some other Example herein, comprising more than one TRE.

Example 6

The robotic jellyfish according to one or more of Example 1 to Example 5 or some other Example herein, wherein the fin or curtain is a spring which rebounds after being compressed.

Example 7

The robotic jellyfish according to one or more of Example 1 to Example 6 or some other Example herein, wherein the jellyfish body comprises fibers or tendons.

Example 8

The robotic jellyfish according to one or more of Example 1 to Example 7 or some other Example herein, wherein the TRE is connected to the fin or curtain by tendons, fibers, semi-flexible or rigid rods.

Example 9

The robotic jellyfish according to one or more of Example 1 to Example 8 or some other Example herein, further comprising a variable displacement component, which may expand or contract to cause the robotic jellyfish to ascend or descend.

Example 10

The robotic jellyfish according to one or more of Example 1 to Example 9 or some other Example herein, wherein the variable displacement component may increase displacement when a power source is depleted, when a depth is sensed, or the like.

Example 11

The robotic jellyfish according to one or more of Example 1 to Example 10 or some other Example herein, wherein a dome of the robotic jellyfish transmits an electromagnetic radiation.

Example 12

The robotic jellyfish according to one or more of Example 1 to Example 11 or some other Example herein, wherein the dome focuses an electromagnetic radiation.

The invention claimed is:

1. A robotic jellyfish comprising a torque reaction engine ("TRE") and a jellyfish body, wherein the TRE comprises a central shaft, an inertial mass, and a motor, wherein the inertial mass and the central shaft rotate relative to one another around a common axis, wherein the motor causes the inertial mass to change its acceleration relative to the central shaft and produces a torque reaction on the central shaft, wherein the torque reaction on the central shaft causes the TRE to oscillate, opposite the change in acceleration of the inertial mass, wherein the jellyfish body comprises a tubular curtain, wherein the jellyfish body is secured to the TRE, and wherein oscillation of the TRE causes a wave to pass through the tubular curtain.

2. The robotic jellyfish according to claim 1, wherein the jellyfish body further comprises a dome.

3. The robotic jellyfish according to claim 2, wherein the tubular curtain is a flexible material.

4. The robotic jellyfish according to claim 1, wherein the wave is caused by a transient compression of the tubular curtain induced by the oscillation of the TRE.

5. The robotic jellyfish according to claim 1, wherein the wave accelerates a thrust fluid surrounding the robotic jellyfish and produces thrust.

6. The robotic jellyfish according to claim 1, wherein the TRE is secured to the jellyfish body by a set of tendons.

7. The robotic jellyfish according to claim 1, wherein the TRE is a first TRE and the robotic jellyfish comprises a second TRE.

8. The robotic jellyfish according to claim 1, wherein a pressure vessel surrounds the TRE.

9. The robotic jellyfish according to claim 8, wherein the pressure vessel is toroidal in shape.

10. The robotic jellyfish according to claim 8, wherein the pressure vessel comprises a passage, wherein the passage passes through a center of the pressure vessel.

11. The robotic jellyfish according to claim 8, wherein the pressure vessel is secured to the jellyfish body.

12. The robotic jellyfish according to claim 1, wherein the motor is an electric motor.

13. The robotic jellyfish according to claim 1, wherein the motor in the TRE is controlled by a controller.

14. The robotic jellyfish according to claim 13, wherein the controller cyclically reverses an acceleration vector of the inertial mass, thereby causing the torque reaction on the central shaft.

15. The robotic jellyfish according to claim 14, wherein the controller cyclically reverses the acceleration vector of the inertial mass in a first phase and a second phase.

16. The robotic jellyfish according to claim 15, wherein the first phase applies power to the motor to accelerate the inertial mass.

17. The robotic jellyfish according to claim 15, wherein the second phase applies a brake to decelerate the inertial mass.

18. The robotic jellyfish according to claim 17, wherein the brake generates power.

* * * * *